US006145198A

United States Patent [19]

Karmeli

[11] Patent Number: 6,145,198

[45] Date of Patent: Nov. 14, 2000

[54] METHOD OF MAKING A SPRING FOR EARRING CLIP

[76] Inventor: David D. Karmeli, 181 Madison Ave., New York, N.Y. 10016

[21] Appl. No.: 09/396,008

[22] Filed: Sep. 15, 1999

Related U.S. Application Data

[62] Division of application No. 09/015,813, Jan. 29, 1998, Pat. No. 5,983,669.

[51] Int. Cl.[7] ..... A44C 27/00

[52] U.S. Cl. ..... 29/896.42; 29/896.9; 72/381; 72/398

[58] Field of Search ..... 29/896.8, 896.9, 29/896.42; 72/381, 384, 398, 401; 267/164; 24/511, 563; 63/14.4, 14.5

[56] References Cited

U.S. PATENT DOCUMENTS 668,395 2/1901 Stirckler ..... 72/401

3,564,899 2/1971 Finzer ..... 72/381

FOREIGN PATENT DOCUMENTS 2229 9/1853 United Kingdom ..... 72/398

678177 8/1952 United Kingdom ..... 72/381

*Primary Examiner*—P. W. Echols

*Attorney, Agent, or Firm*—Notaro & Michalos P.C.

[57] ABSTRACT

An earring clip spring assembly has a strip of spring metal which is bent to have a pair of spring arms connected to each other by a closed U-shaped portion. An opening through the omega shaped portion receives a pin which holds the spring to an earring clip. A method of making the bent earring clip has two sets of dies for bending the clip in separate steps into its final shape.

4 Claims, 6 Drawing Sheets

METHOD OF MAKING A SPRING FOR EARRING CLIP

CROSS-REFERENCE TO RELATED APPLICATIONS

This application is a divisional application of U.S. Ser. No. 09/015,813, filed Jan. 29, 1998, now U.S. Pat. No. 5,983,669.

FIELD AND BACKGROUND OF THE INVENTION

The present invention relates in general to springs, and in particular, to a new and useful clasp spring for a clip-on earring which is inexpensive to manufacture yet effective in use.

Clip-on earrings utilize springs which hold the earring clasp firmly against the earlobe. As shown in FIG. 1, the springs are generally made of a monolithic member generally designated 10 having front and rear spring arms 12, 14 and a journal 16 formed as one piece with or soldered to the spring arms. The shaft of an earring clip extends through the opening 18 in journal 16. This type of spring is relatively expensive to make despite its very utilitarian purpose and the fact that it is normally not visible when the earring is worn.

SUMMARY OF THE INVENTION

An object of the present invention is to provide a spring for an earring clasp or clip which is far simpler in construction and more economical to manufacture. Instead of casting or soldering together parts, the present invention uses a strip of spring metal which is bent into a closed U-shape.

The present invention includes both the structure for the spring and the method of making the spring as well as a combination of the spring with the clasp and body of an earring.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which embodiments of the invention are illustrated.

DESCRIPTION OF THE PREFERRED EMBODIMENT

Figure 1:
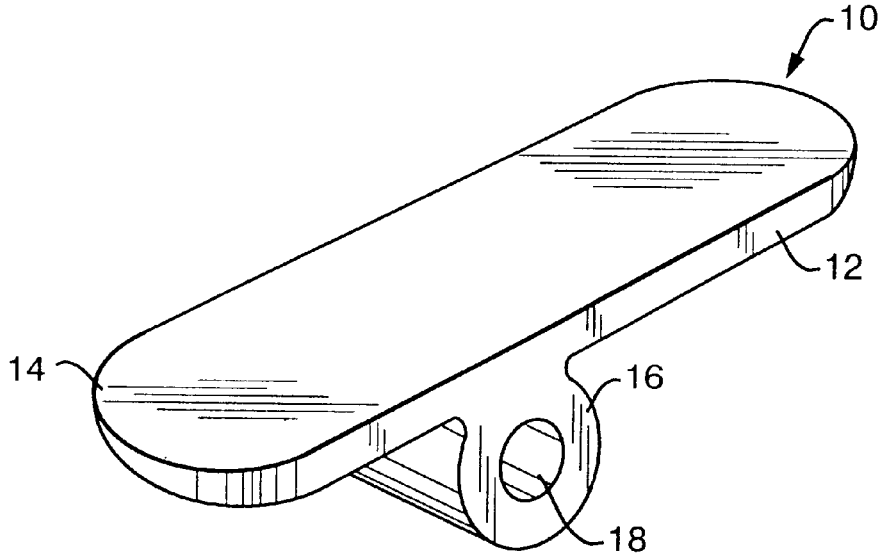
FIG. 1 (PRIOR ART)
FIG. 1 is a perspective view of a known spring for clip-on earrings.
Figure 2:
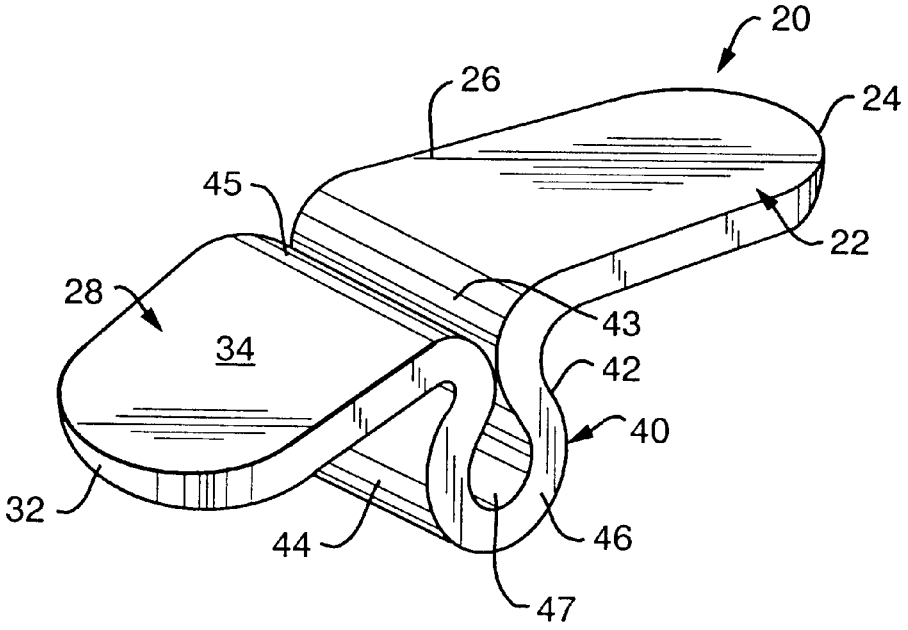
FIG. 2 is a perspective view of the spring in accordance with the present invention.

Referring to the drawings in particular, the invention embodied in FIG. 2 comprises a spring generally designated 20 for biasing the clasp or clip of a clip-on earring, which is made of a single strip of metal having a spring characteristic. Although precious metal such as gold or silver may be used, other metals with appropriate springiness such as stainless steel or other appropriate sheet metal material may be utilized.

Spring 20 has a first spring arm 22 which has a rounded outer end 24 and a flat or nearly planer portion 26. Spring 20 also includes a second advantageously shorter spring arm 28 which also has a rounded end 32 and a generally planar portion 34 which extends at an obtuse angle of approximately 130° to the portion 26. This angle (see x in FIG. 3) may be from about 90 to 190° in extreme cases but preferably the angle is between 100 and 190°. The planar portions 26 and 34 also may be slightly bowed outwardly or inwardly toward the respective ends 24 and 32, from a substantially central closed U-shaped portion 40 which is connected to and formed as one piece with the arms 22 and 28. Closed U-shaped portion 40 forms a pair of inner bends 42 and 44 with respective arms 22 and 32, and has a cylindrical portion 46 connected between the inner bends. Each of the arms 22 and 32 also have a pair of outer bends 43 and 45 which are respectively opposite the inner bends 42 and 44, and touch each other or nearly touch each other at the top of cylindrical portion 46 to form a journal opening 47. The purpose of journal opening 47 is to receive a pivot mounting pin for mounting the spring 20 to the clip or clasp of the earring.

Figure 3:
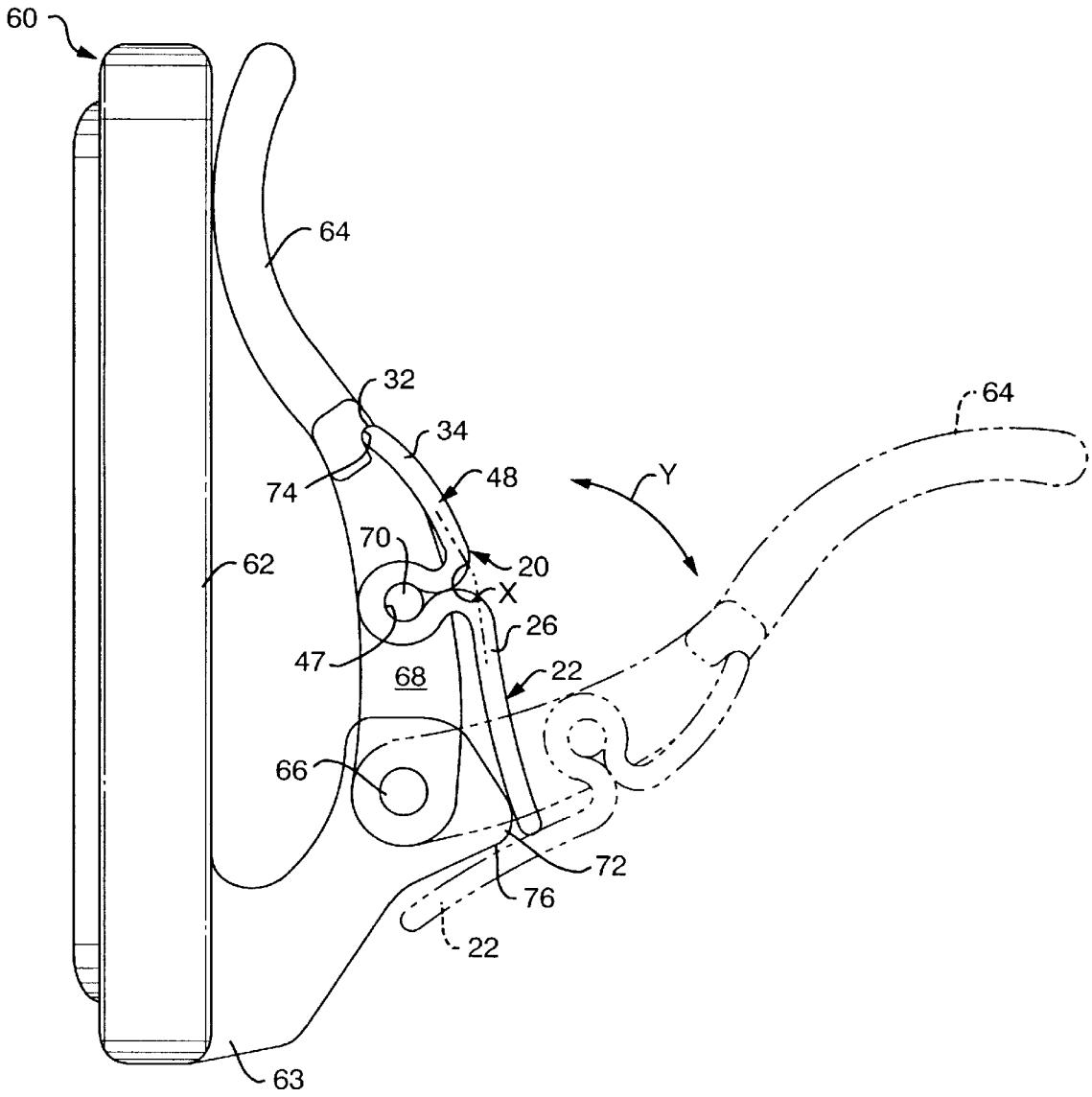
FIG. 3 is a schematic side elevational view of an earring with a clasp and the spring of the present invention.
Figure 4:
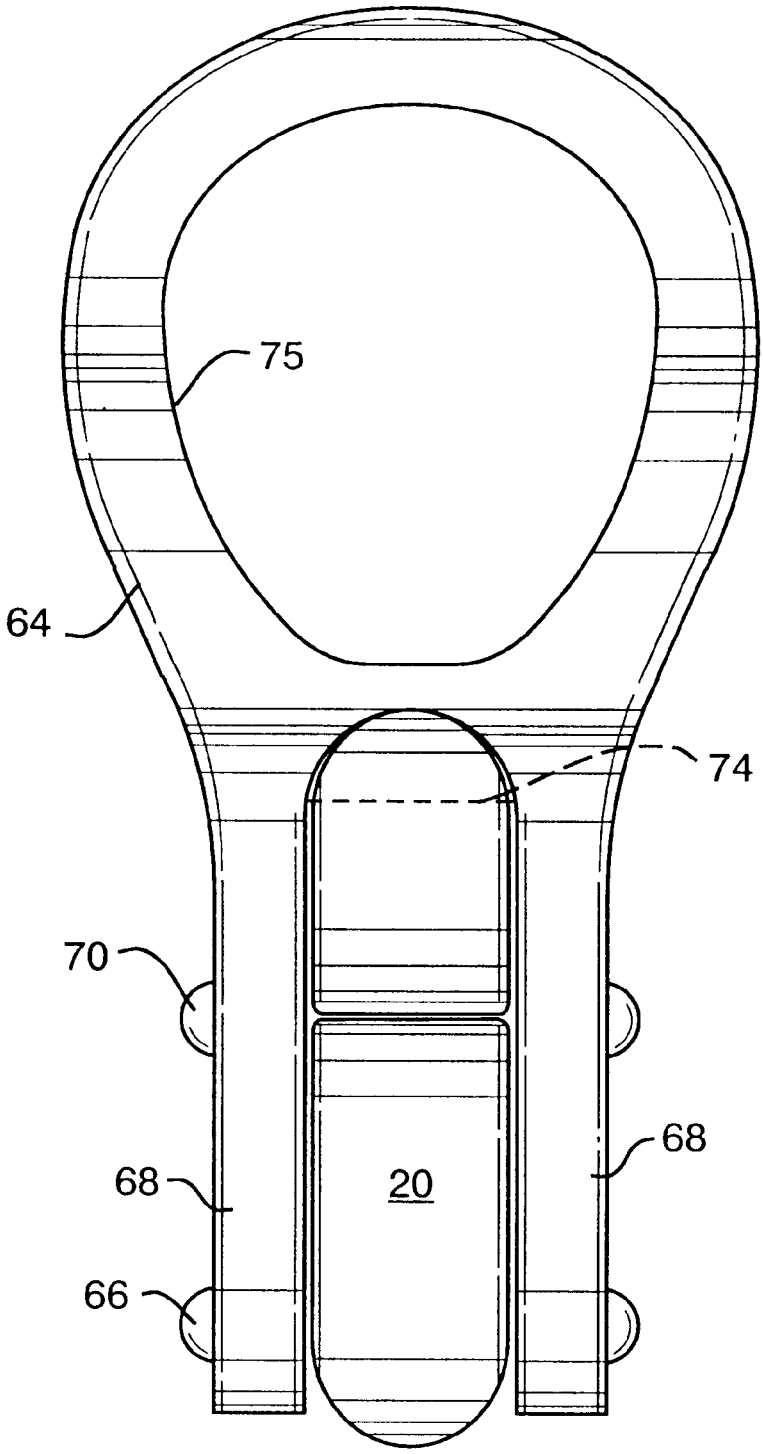
FIG. 4 is a rear elevational view of the clasp and spring of the present invention.

FIG. 3 illustrates an example of an earring generally designated 60 connected with the spring of the present invention. Earring 60 includes an ornamental body 62 having an attachment portion 63, for example, a raised pedestal of metal soldered to the rear of ornamental body 62. A clip or clasp 64 shown also in FIG. 4, is pivotally connected to attachment portion 63 by a pivot pin 66 which extends through a pair of ears 68 at one end of clip 64 and a hole through the attachment portion 63. Ears 68, 68 include a second pair of holes which are spaced from the holes that receive pin 66 and are aligned with the journal opening 47 of spring 20, to receive a mounting pin 70. This holds spring 20 to clip 64 and also positions the spring so that its longer spring arm portion 22 extends out over and engages with a projection 72 formed as a high point on attachment portion 63. The end 32 of the shorter spring arm 28 rests in a notch 74 formed at the base of the junction between ears 68. This fixes the relative position between the spring end 32 and clip 64, allowing the opposite arm 22 to ride on projection 72 as clip 64 is moved from its engagement position shown in solid line in FIG. 3 to its open position shown in phantom line in FIG. 3 in the direction of arrow Y. In the open position, the spring arm 22 lies near or against a stop plane 76 which is on an opposite side of the projection 72 from the opening between clip ears 68, 68 which receive spring 20. In this way, clip 64 can be held in its open position automatically by the interaction of the spring with the attachment portion 63. As shown in FIG. 4, the engagement end of clip 64 may include an opening 75 therethrough to reduce weight but the opening is not essential.

Figure 5:
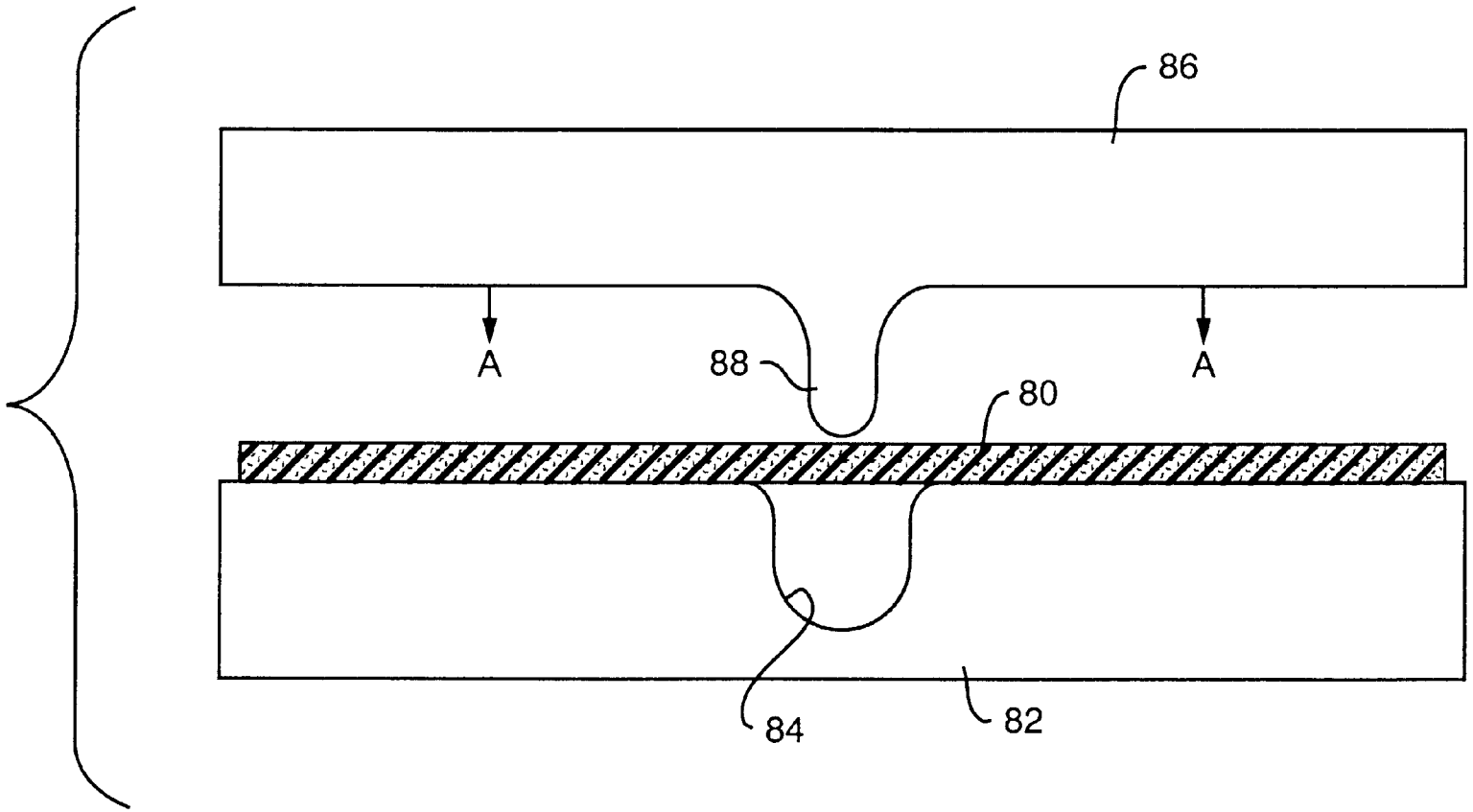
FIG. 5 is a schematic side view of a first step in the process of manufacturing the spring of the present invention.
Figure 6:
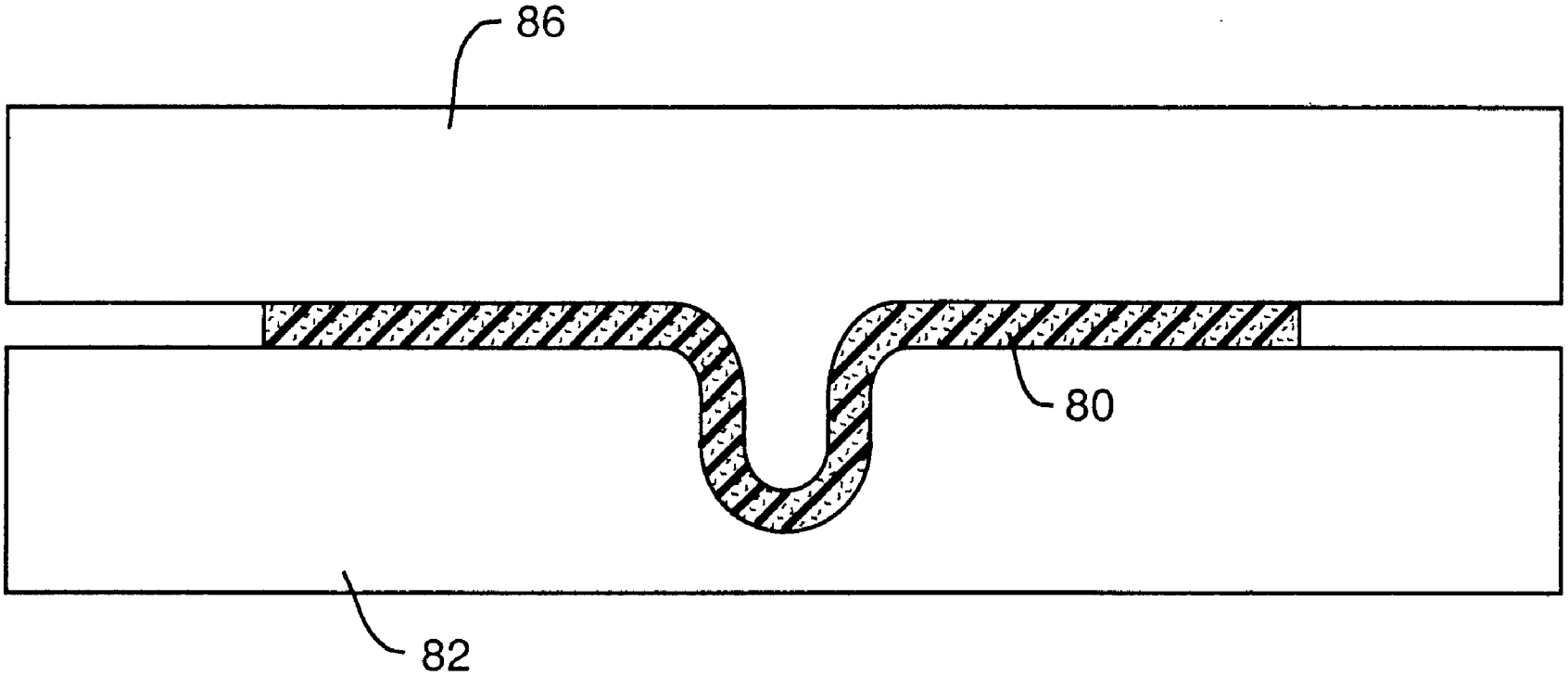
FIG. 6 is a view similar to FIG. 5 of a second step in the process.

Referring now to FIGS. 5–8, the process of making the spring of the present invention, as shown in FIG. 5, comprises positioning a strip of metal 80 between a female die 82 having a recess 84 shaped to form the cylindrical portion 46 of spring 20 and a male die 86 having a projection 88. When the male and female die parts are moved toward each other, for example in the direction of arrows A,A, projection 88 pushes a middle portion of strip 80 into recess 84 as shown in FIG. 6. This begins the shaping of the cylindrical part 46 of the omega shaped portion 40 in the spring as shown in FIG. 6.

Figure 7:
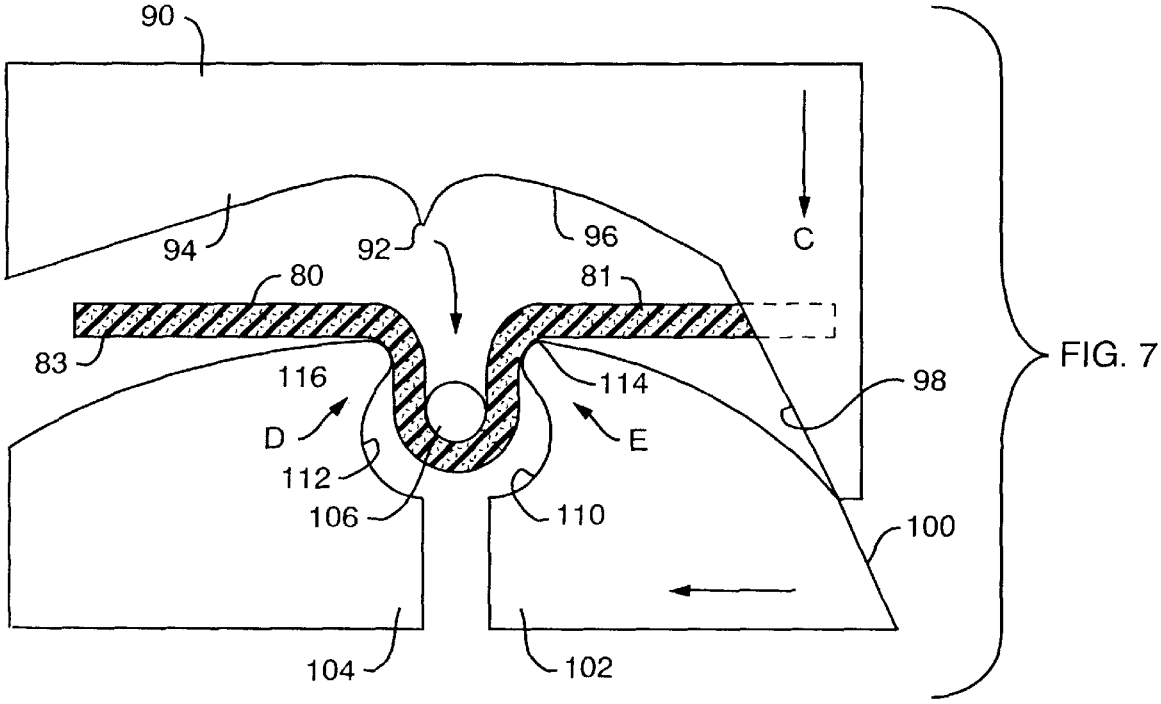
FIG. 7 is a schematic side view of a third step in the process of manufacturing the present invention.

Thus formed strip 80 is then placed between the dies of a second tool shown in FIG. 7. This includes an upper shaping die 90 having a pushing projection 92 and a pair of curved recesses 94 and 96. Die 90 also includes an incline 98 which rides against an incline 100 of a first lower die part 102. A second lower die 104 cooperates with lower die 102 and upper die 90. The three dies move in respective directions C, D and E, to close the die cavity as shown in FIG. 8 and apply a final shaping step to the now formed spring 20.

Returning to FIG. 7, in order to insure proper cooperation between the parts, a die pin 106 is received within the semi-cylindrical bend which was previously formed in strip 80. Dies 102 and 104 include a pair of cylindrical recesses 110 and 112 and a pair of projections 114 and 116 which move inwardly as the dies 104 and 102 move together to form the inner bends 42 and 44. Pushing the adjacent portions of the strip 80 together, also form the outer bends 43 and 45 as shown in FIG. 8. Die pin 106 insures that the journal opening 47 is properly shaped.

Figure 8:
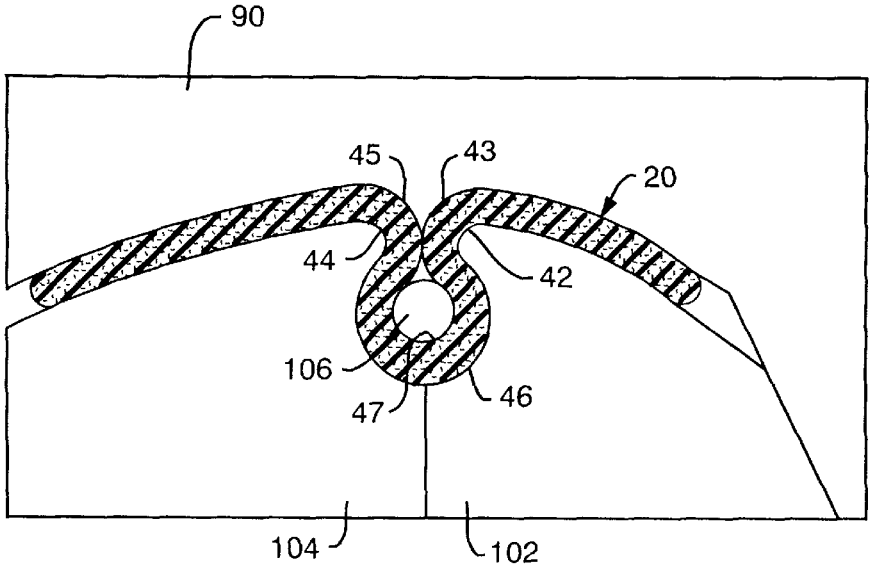
FIG. 8 is a view similar to FIG. 7 of the final step in manufacturing the spring of the present invention.

Before the steps of FIGS. 7 and 8, arm 81 is either clipped shorter than the opposite arm 83 by a cutting tool (not shown) and both arms are given their rounded ends, in particular for cutting the rounded ends 32 and 24 on the spring arms of the spring.

The springiness of spring 20 is either due to the use of a spring material such as strip 80 or tempering of the spring after it has been shaped. A die striking adds springiness to metals in general by compacting the molecules in the metal strip (work tempering).

While a specific embodiment of the invention has been shown and described in detail to illustrate the application of the principles of the invention, it will be understood that the invention may be embodied otherwise without departing from such principles.

What is claimed is:

1. A method of manufacturing an earring clip spring comprising:

providing a first die set comprising a lower female die having a recess and an upper male die having a projection;

placing a substantially flat strip of metal between the dies of the first die set in a position spanning the projection and recess;

moving the dies of the first die set toward each other to push a portion of the spring metal strip into the recess using the projection moving into the recess, to form a semi-cylindrical bend and a pair of inner and outer bends in the strip of metal;

providing a second die set comprising an upper male die with a projection and a pair of lower female dies each with a partial cylindrical recess and a pushing projection adjacent the partial cylindrical recess;

placing the bent strip of spring metal from the first die set, between the dies of the second die set with the inner bends adjacent respective pushing projections of the pair of lower female dies;

moving the pair of female dies of the second die set toward each other and moving the male die of the second die set toward the female dies for pushing the inner bends and outer bends toward each other to close an opening in the semi-cylindrical portion to form the spring; and placing a die pin in the semi-cylindrical bend of the strip of metal to hold it with respect to the dies of the second die set while the dies of the second die set are moved toward each other, one of the female dies of the second die set and the male die of the second die set having inclined surfaces sliding against each other as the dies of the second die set move together to align the dies of the second die set with each other.

2. A method according to claim 1 including providing the male die of the second die set to have a pair of curved surfaces on opposite sides of the male projection thereof and each of the female dies of the second die set include upper curved portions which, with the dies of the second die set, move toward each other, bend portions of the spring metal to form bent spring arms on opposite sides of the semi-cylindrical band.

3. A method according to claim 2 including bending the strip of spring metal so that the outer bends substantially touch each other above the die pin.

4. A method according to claim 1 including work tempering the spring by pressing the bent strip between the dies of the second die set to make the metal strip springy.

* * * * *